US008624804B2

(12) United States Patent
Ryu et al.

(10) Patent No.: US 8,624,804 B2
(45) Date of Patent: Jan. 7, 2014

(54) METHOD OF DRIVING ORGANIC LIGHT EMITTING DIODE DISPLAY DEVICE IN AN INTERLACED SCANNING MODE IN WHICH A SINGLE FRAME IS DIVIDED

(75) Inventors: Do-Hyung Ryu, Suwon-si (KR); Do-Ik Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 973 days.

(21) Appl. No.: 12/118,901

(22) Filed: May 12, 2008

(65) Prior Publication Data

US 2008/0316232 A1 Dec. 25, 2008

(30) Foreign Application Priority Data

Jun. 21, 2007 (KR) ..... 10-2007-0061258

(51) Int. Cl.
*G09G 3/30* (2006.01)
*G09G 5/10* (2006.01)

(52) U.S. Cl.
USPC ..... 345/77; 345/690

(58) Field of Classification Search
USPC ..... 345/60, 77, 690
See application file for complete search history.

(56) References Cited

U.S. PATENT DOCUMENTS

| | | | | |
|---|---|---|---|---|
| 6,369,782 | B2 * | 4/2002 | Shigeta | 345/63 |
| 7,139,007 | B1 * | 11/2006 | Kawahara | 345/690 |
| 2002/0097201 | A1 * | 7/2002 | Yamamoto et al. | 345/60 |
| 2005/0062690 | A1 * | 3/2005 | Jeong | 345/63 |
| 2005/0162356 | A1 * | 7/2005 | Koyama et al. | 345/76 |
| 2005/0219234 | A1 * | 10/2005 | Aiba et al. | 345/204 |
| 2007/0008250 | A1 * | 1/2007 | Hoppenbrouwers et al. | 345/76 |

FOREIGN PATENT DOCUMENTS

| | | |
|---|---|---|
| JP | 7-261696 | 10/1995 |
| JP | 2005-250449 | 9/2005 |
| KR | 2000-16955 | 3/2000 |
| KR | 2001-0109471 | 12/2001 |
| KR | 2002-0020244 | 3/2002 |
| KR | 2003-0021483 | 3/2003 |
| KR | 2005-101913 | 10/2005 |

OTHER PUBLICATIONS

Notice of Allowability issued in Korean Patent Application No. 2007-61258 on Nov. 20, 2008.

* cited by examiner

*Primary Examiner* — Chanh Nguyen
*Assistant Examiner* — John Kirkpatrick
(74) *Attorney, Agent, or Firm* — Christie, Parker & Hale, LLP

(57) ABSTRACT

A method of driving an organic light emitting diode (OLED) display device that displays grayscales in a time-division manner and can prevent the occurrence of false contours and flickers at an interface between neighboring grayscales when displaying sequential images, such as moving images, at a high speed. The method is an interlaced scanning method in which a single frame is divided into an odd-numbered field and an even-numbered field that are sequentially driven, and includes dividing each of the odd-numbered field and the even-numbered field into x sub-frame groups; dividing each of a plurality of sub-frames corresponding to bits of driving data into y divided sub-frame portions; and disposing the y divided sub-frame portions in different ones of the x sub-frame groups.

11 Claims, 4 Drawing Sheets

METHOD OF DRIVING ORGANIC LIGHT EMITTING DIODE DISPLAY DEVICE IN AN INTERLACED SCANNING MODE IN WHICH A SINGLE FRAME IS DIVIDED

CROSS-REFERENCE TO RELATED APPLICATION

This application claims the benefit of Korean Patent Application No. 2007-0061258 filed on Jun. 21, 2007, in the Korean Intellectual Property Office, the disclosure of which is incorporated herein by reference in its entirety.

BACKGROUND OF THE INVENTION

1. Field of the Invention

Aspects of the invention relate to a method of driving an organic light emitting diode (OLED) display device, and more particularly to a method of driving a time-division grayscale OLED display device that can prevent false contours and flickers from occurring at an interface between neighboring grayscales when displaying a moving image.

2. Description of the Related Art

A flat panel display device (FPD) is a display device that has largely superseded a cathode-ray tube (CRT) display device because the FPD is fabricated to be lightweight and thin. Typical examples of the FPD are a liquid crystal display device (LCD) and an organic light emitting diode (OLED) display device. Compared to the LCD, the OLED display device has a higher luminance and a wider viewing angle, and can be made thinner because the OLED display device does not require a backlight.

In the OLED display device, electrons and holes are injected into an organic thin layer through a cathode and an anode and recombine in the organic thin layer to generate excitons, thereby emitting light of a certain wavelength.

OLED display devices may be classified into a passive matrix type and an active matrix type depending on how N×M pixels arranged in a matrix are driven. An active matrix type OLED display device includes a circuit using a thin film transistor (TFT) to drive the pixels. A passive matrix type OLED display device can be fabricated using a simple process since anodes and cathodes are merely formed to cross each other to form a matrix of pixels in a display region. However, the passive matrix type OLED display device is applied only to low-resolution, small-sized display devices because it has a limited resolution, requires a high driving voltage, and its materials have short lifetimes. In contrast, in the active matrix type OLED display device, a TFT is provided in each pixel in a display region. Thus, a constant amount of current can be supplied to each pixel so that the active matrix type OLED display device can emit light with a stable luminance. Also, since the active matrix type OLED display device has a low power consumption, the active matrix type OLED display device can be applied to high-resolution, large-sized display devices.

Conventionally, an OLED display device displays a plurality of grayscales using a time-division method that divides a single frame into a plurality of sub-frames corresponding to bits of driving data and having different brightness ratios, and turns pixels on or off during the sub-frames according to the grayscale to be displayed. However, when sequential images, such as moving images, are displayed at a high speed, the emission times of neighboring grayscales become out of sequence due to the properties of human vision. Thus, false contours, which are generated by perceiving the images at a higher or lower grayscale level than the displayed grayscale, and flickering images (or flickers) occur.

SUMMARY OF THE INVENTION

Aspects of the invention relate to a method of driving an organic light emitting diode (OLED) display device using a time-division driving method that can prevent the occurrence of false contours and flickers when displaying sequential images, such as moving images, at a high speed.

According to an aspect of the invention, a method of driving an organic light emitting diode (OLED) display device in an interlaced scanning mode in which a single frame is divided into an odd-numbered field and an even-numbered field that are sequentially driven includes dividing each of the odd-numbered field and the even-numbered field into x sub-frame groups; dividing each of a plurality of sub-frames corresponding to bits of driving data into y divided sub-frame portions; and disposing the y divided sub-frame portions in different ones of the x sub-frame groups.

According to an aspect of the invention, a method of driving an organic light emitting diode (OLED) display device in an interlaced scanning mode in which a single frame is divided into an odd-numbered field and an even-numbered field that are sequentially driven includes dividing each of the odd-numbered field and the even-numbered field into x sub-frame groups; dividing some of a plurality of sub-frames corresponding to bits of driving data into y divided sub-frame portions; and disposing the y divided sub-frame portions in different ones of the x sub-frame groups.

According to an aspect of the invention, a method of driving an organic light emitting diode (OLED) display device in an interlaced scanning mode in which a single frame is divided into an odd-numbered field and an even-numbered field that are sequentially driven includes dividing each of the odd-numbered field and the even-numbered field into x sub-frame groups; dividing some of a plurality of sub-frames corresponding to bits of driving data into y divided sub-frame portions; dividing some other ones of the sub-frames corresponding to the bits of the driving data into z divided sub-frame portions; disposing the y divided sub-frame portions in different ones of the x sub-frame groups; and disposing the z divided sub-frame portions in different ones of the x sub-frame groups.

Additional aspects and/or advantages of the invention will be set forth in part in the description that follows, and, in part, will be obvious from the description, or may be learned by practice of the invention.

BRIEF DESCRIPTION OF THE DRAWINGS

The above and/or other aspects and advantages of the invention will become apparent and more readily appreciated from the following description of embodiments of the invention, taken in conjunction with the accompanying drawings of which.

DETAILED DESCRIPTION OF THE EMBODIMENTS

Figure 1:
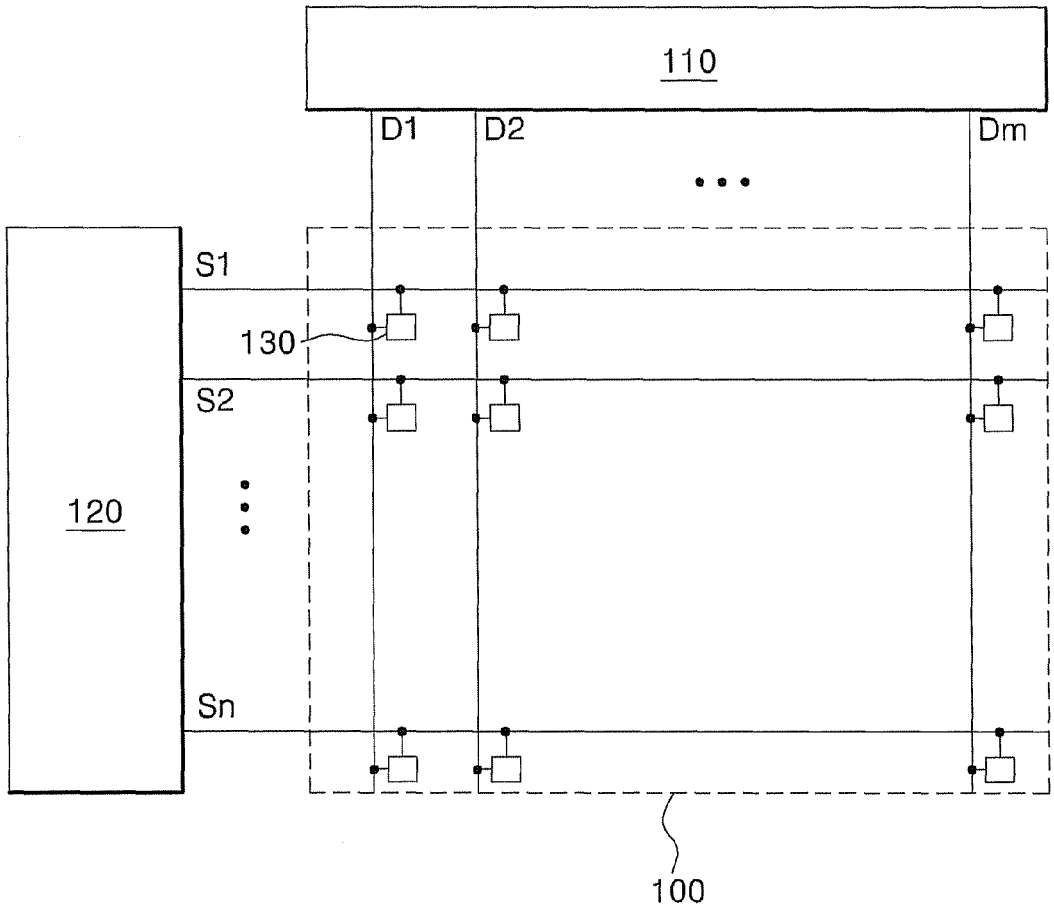
FIG. 1 is a diagram of the configuration of an organic light emitting diode (OLED) display device according to an aspect of the invention.

Reference will now be made in detail to embodiments of the invention, examples of which are shown in the accompanying drawings, wherein like reference numerals refer to like elements throughout. The embodiments are described below in order to explain the invention by referring to the figures.

Figure 2:
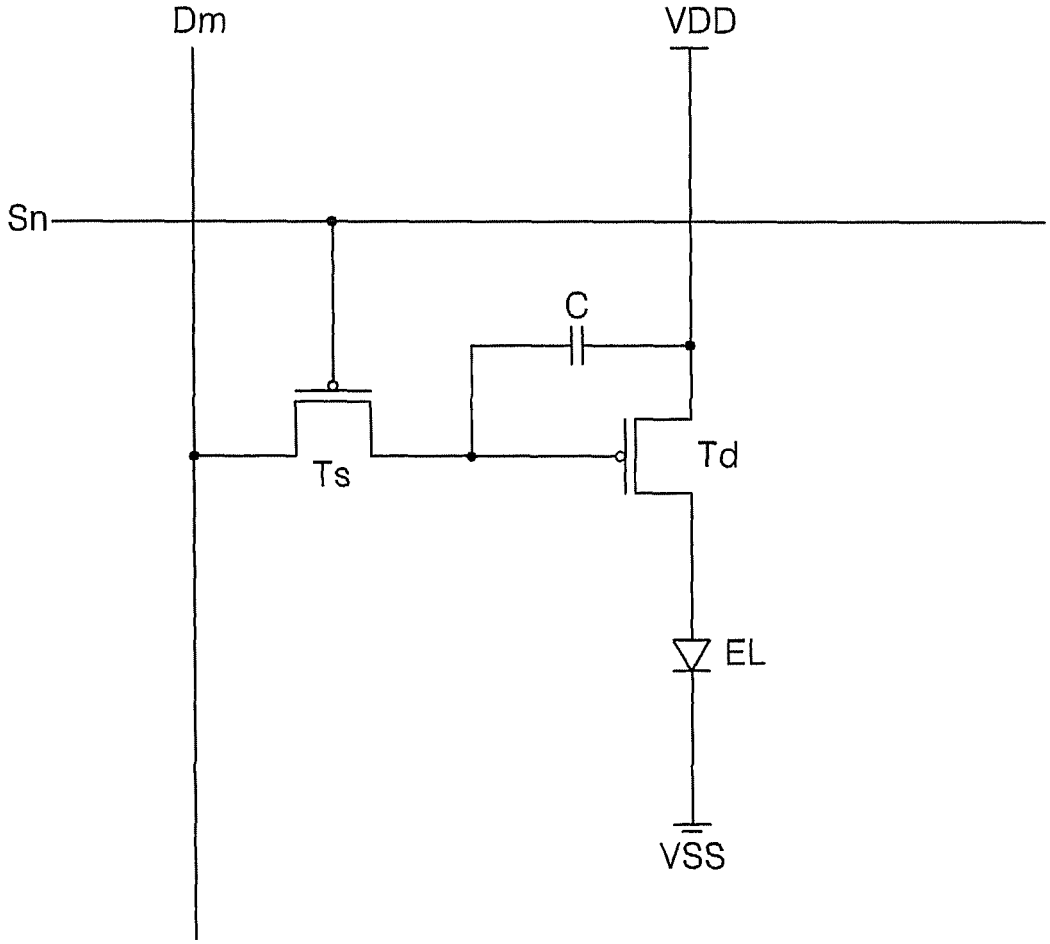
FIG. 2 is a circuit diagram of a pixel of the OLED display device of FIG. 1 according to an aspect of the invention.

FIG. 1 is a diagram of the configuration of an organic light emitting diode (OLED) display device according to an aspect of the invention, and FIG. 2 is a circuit diagram of a pixel of the OLED display device of FIG. 1 according to an aspect of the invention.

Referring to FIGS. 1 and 2, the OLED display device includes a display panel 100 having a plurality of pixels 130, a data driver 110 for applying a driving data signal to the display panel 100 through data lines D1 to Dm, and a scan driver 120 for applying a scan signal to the display panel 100 through scan lines S1 to Sn.

Each of the pixels 130 includes an organic light emitting diode EL interposed between a first power supply voltage line VDD and a second power supply voltage line VSS, a driving transistor Td interposed between the organic light emitting diode EL and the first power supply voltage line VDD, a switching transistor Ts interposed between a gate terminal of the driving transistor Td and the data line Dm, and a capacitor C interposed between the gate terminal of the driving transistor Td and the first power supply voltage line VDD.

The switching transistor Ts is turned on or off in response to a scan signal applied through the scan line Sn, and when it is turned on, it transmits the driving data signal through the data line Dm to the gate terminal of the driving transistor Td. The driving transistor Td is turned on or off in response to the driving data signal transmitted by the switching transistor Ts, and when it is turned on, it supplies a driving current to the organic light emitting diode EL. The driving data signal is composed of a plurality of bits, and a grayscale displayed by the organic light emitting diode EL is determined by brightness ratios of a plurality of sub-frames corresponding to the bits of the driving data. For example, the driving data signal may be composed of 8 bits, and there may be 8 sub-frames corresponding to the 8 bits having brightness ratios of 1, 2, 4, 8, 16, 32, 64, and 128, enabling 256 grayscales of 0 to 255 to be displayed. In such an example, a driving data signal of 10010011, where the left-most bit is the most significant bit, would represent a grayscale of 128+16+2+1=147. The different brightness ratios may be provided by providing sub-frames having different time lengths. For example, a sub-frame having a brightness ratio of 128 may have a time length that is 128 times long as a time length of a sub-frame having a brightness ratio of 1. However, it is understood that other numbers of bits, other numbers of sub-frames, other brightness ratios, other orders of brightness ratios, and other methods of providing the different brightness ratios may be used.

Figure 3:
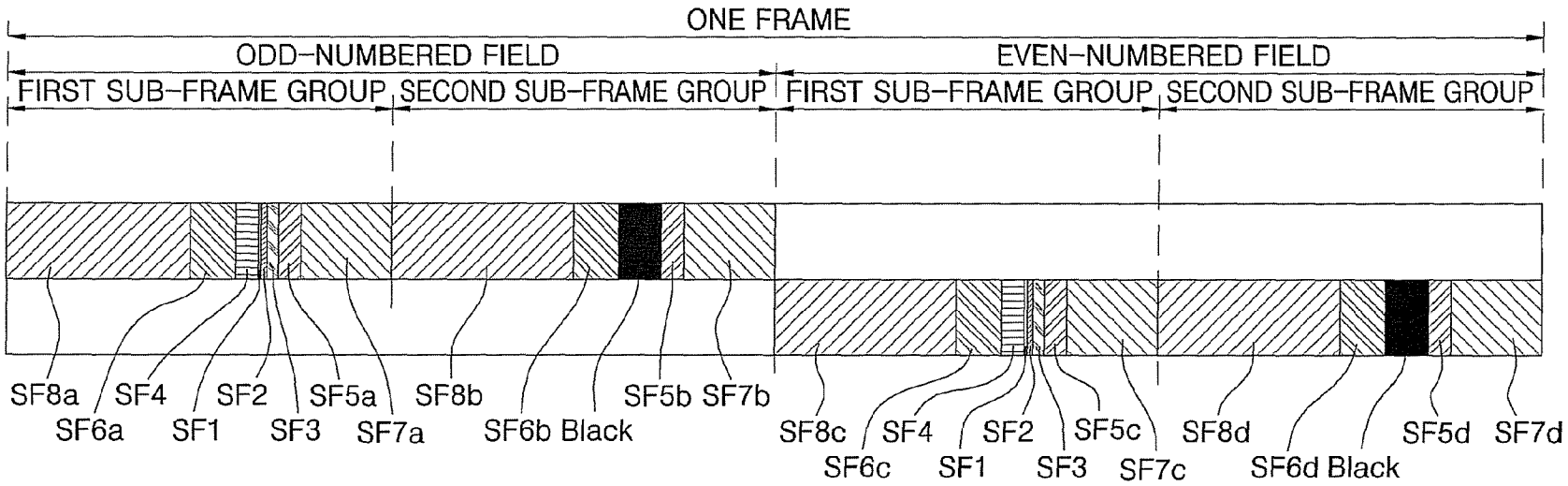
FIG. 3 is a timing diagram of a method of driving an OLED display device according to an aspect of the invention.

FIG. 3 is a timing diagram of a method of driving an OLED display device according to an aspect of the invention when 8-bit driving data is used to display 256 grayscales.

Referring to FIG. 3, a single frame is divided into an odd-numbered field in which a plurality of pixels connected to odd-numbered scan lines S1 to Sn−1 are driven, and an even-numbered field in which a plurality of pixels connected to even-numbered scan lines S2 to Sn are driven, and the odd-numbered field and the even-numbered field are sequentially driven.

Each of the odd-numbered field and the even-numbered field is divided into a first sub-frame group and a second sub-frame group, and some of a plurality of sub-frames corresponding to bits of driving data are divided into two divided sub-frame portions that are disposed in the first sub-frame group and the second sub-frame group. For example, in FIG. 3, there are 8 sub-frames SF1 to SF8 respectively corresponding to the 8 bits of the driving data, with SF1 corresponding to a least significant bit, and SF8 corresponding to a most significant bit. However, it is understood that other arrangements are possible.

For example, as shown in FIG. 3, in the odd-numbered field, the sub-frames SF5, SF6, SF7, and SF8 corresponding to the 4 most significant bits of the driving data are divided into two divided sub-frame portions SF5*a* and SF5*b*; SF6*a* and SF6*b*; SF7*a* and SF7*b*; and SF8*a* and SF8*b*. The divided sub-frame portions SF5*a*, SF6*a*, SF7*a*, and SF8*a* are disposed in the first sub-frame group, and the divided sub-frame portions SF5*b*, SF6*b*, SF7*b*, and SF8*b* are disposed in the second sub-frame group. The positions of the divided sub-frame portions SF5*a*, SF6*a*, SF7*a*, and SF8*a* in the first sub-frame group may correspond to the positions of the divided sub-frame portions SF5*b*, SF6*b*, SF7*b*, and SF8*b* in the second sub-frame group. However, it is understood that other arrangements are possible.

Similarly, in the even-numbered field, the sub-frames SF5, SF6, SF7, and SF8 are divided into two divided sub-frame portions SF5*c* and SF5*d*; SF6*c* and SF6*d*; SF7*c* and SF7*d*; and SF8*c* and SF8*d*. The divided sub-frame portions SF5*c*, SF6*c*, SF7*c*, and SF8*c* are disposed in the first sub-frame group, and the divided sub-frame portions SF5*d*, SF6*d*, SF7*d*, and SF8*d* are disposed in the second sub-frame group. The positions of the divided sub-frame portions SF5*c*, SF6*c*, SF7*c*, and SF8*c* in the first sub-frame group may correspond to the positions of the divided sub-frame portions SF5*d*, SF6*d*, SF7*d*, and SF8*d* in the second sub-frame group. However, it is understood that other arrangements are possible.

The sub-frames SF1, SF2, SF3, and SF4 corresponding to the 4 least significant bits of the driving data are undivided, and may be disposed between the first sub-frame group and the second sub-frame group of each of the odd-numbered field and the even-numbered field, so that the divided sub-frame portions SF5*a*, SF5*b*, SF6*a*, SF6*b*, SF7*a*, SF7*b*, SF8*a*, and SF8*b* are symmetrically disposed in the odd-numbered field, and the divided sub-frame portions SF5*c*, SF5*d*, SF6*c*, SF6*d*, SF7*c*, SF7*d*, SF8*c*, and SF8*d* are symmetrically disposed in the even-numbered field. Thus, the brightness ratios of the first sub-frame group and the second sub-frame group can be symmetrical to reduce the occurrence of false contours and flickers. This particular arrangement is not shown in the figures.

Alternatively, as shown in FIG. 3, the undivided sub-frames SF1, SF2, SF3, and SF4 corresponding to the 4 least significant bits of the driving data may be disposed in the first sub-frame group of each of the odd-numbered field and the even-numbered field, and a black sub-frame "Black" for displaying a black grayscale and having the same brightness ratio as a combination of the undivided sub-frames SF1, SF2, SF3, and SF4 may be disposed in the second sub-frame group of each of the odd-numbered field and the even-numbered field so that a contrast ratio can be improved and the occurrence of false contours and flickers at an interface between neighboring grayscales can be prevented more efficiently. One example of "having the same brightness ratio" is a case in which a time length of the black sub-frame "Black" is equal to a sum of the time lengths of the undivided sub-frames SF1, SF2, SF3, and SF4.

As an alternative to the arrangement shown in FIG. 3, the undivided sub-frames SF1, SF2, SF3, and SF4 may be disposed in the second sub-frame group of each of the odd-numbered field and the even-numbered field, and the black sub-frame "Black" may be disposed in the first sub-frame group of each of the odd-numbered field and the even-numbered field. Alternatively, the undivided sub-frames SF1, SF2, SF3, and SF4 and the black sub-frame "Black" may be disposed between the first sub-frame group and the second sub-frame group of each of the odd-numbered field and the even-numbered field. These particular arrangements are not shown in the figures.

Although FIG. 3 shows the divided sub-frame portions, the undivided sub-frames, and the black sub-frame being disposed in a particular arrangement in a particular order, it is understood that other arrangements and/or orders are possible.

According to aspects of the invention described above, each of the odd-numbered field and the even-numbered field is divided into two sub-frame groups, and some of the sub-frames corresponding to the bits of the driving data are divided into two divided sub-frame portions. However, each of the odd-numbered and even-numbered fields may be divided into a multiple of 2 sub-frame groups, e.g., into four, six, etc., sub-frame groups, and some of the sub-frames corresponding to the bits of the driving data may be divided into a multiple of 2 divided sub-frame portions, e.g., into four, six, etc., divided sub-frame portions.

As an alternative to the arrangement shown in FIG. 3, all of the sub-frames corresponding to the bits of the driving data may be divided into two divided sub-frame portions, and the two divided sub-frame portions may be disposed at the same position in each of the two sub-frame groups of each of the odd-numbered field and the even-numbered field. However, the brightness ratios of the sub-frames SF1, SF2, SF3, and SF4 corresponding to the 4 least significant bits of the driving data are relatively low. Thus, even if the sub-frames SF1, SF2, SF3, and SF4 corresponding to the 4 least significant bits of the driving data are not divided into two divided sub-frame portions, the occurrence of false contours and flickers is not greatly affected. Therefore, dividing the sub-frames SF1, SF2, SF3, and SF4 corresponding to the 4 least significant bits of the driving data into two divided sub-frame portions is typically unnecessary.

The number of sub-frame groups may differ from the number of divided sub-frame portions. Assuming that the number of sub-frame groups is "x", the number of divided sub-frame portions into which some of the sub-frames corresponding to the bits of the driving data are divided is "y", and "x" and "y" are each a natural number, then "y" may be smaller than or equal to "x". In the example shown in FIG. 3, "x"=2 and "y"=2. However, it is understood that other combinations of "x" and "y" are possible within the constraints given.

As a consequence, a method of driving an OLED display device according to an aspect of the invention is an interlaced scanning driving method in which a single frame is divided into an odd-numbered field and an even-numbered field that are sequentially driven. In one example of this method, each of the odd-numbered field and the even-numbered field is divided into two sub-frame groups, and some or all of the sub-frames corresponding to some or all of the bits of driving data are divided into two divided sub-frame portions. By disposing each of the two divided sub-frame portions in a different one of the two sub-frame groups, the emission times of neighboring grayscales can be more accurate when displaying sequential images, such as moving images, at a high speed.

Figure 4:
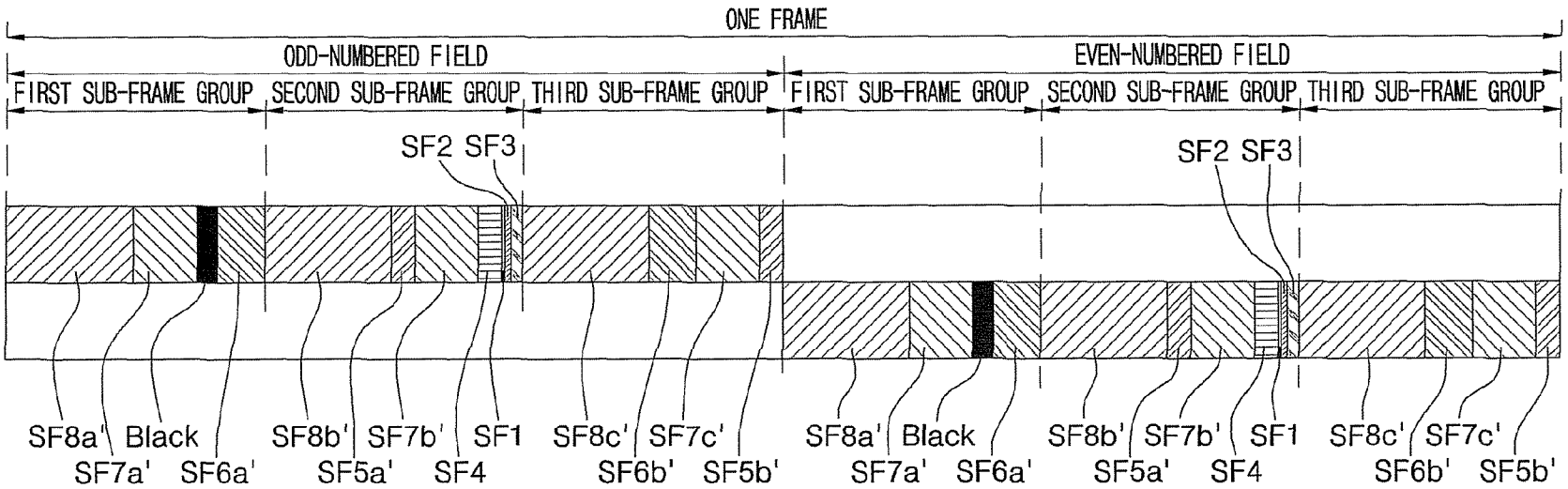
FIG. 4 is a timing diagram of a method of driving an OLED display device according to an aspect of the invention.

FIG. 4 is a timing diagram of a method of driving an OLED display device according to an aspect of the invention when 8-bit driving data is used to display 256 grayscales.

Referring to FIG. 4, a single frame is divided into an odd-numbered field in which a plurality of pixels connected to odd-numbered scan lines S1 to Sn−1 are driven, and an even-numbered field in which a plurality of pixels connected to even-numbered scan lines S2 to Sn are driven, and the odd-numbered field and the even-numbered field are sequentially driven.

Each of the odd-numbered field and the even-numbered field is divided into a first sub-frame group, a second sub-frame group, and a third sub-frame group. Some of a plurality of sub-frames corresponding to bits of driving data are divided into three divided sub-frame portions, some of the sub-frames are divided into two divided sub-frame portions, and remaining ones of the sub-frames are undivided. The brightness ratios of the divided sub-frame portions divided from a particular sub-frame may be made the same to further reduce the occurrence of false contours and flickers.

For example, as shown in FIG. 4, the sub-frames SF7 and SF8 are divided into three divided sub-frame portions SF7*a*', SF7*b*', and SF7*c*'; and SF8*a*', SF8*b*', and SF8*c*'. The sub-frames SF5 and SF6 are divided into two divided sub-frame portions SF5*a*' and SF5*b*; and SF6*a*' and SF6*b*'. The remaining sub-frames SF1, SF2, SF3, and SF4 are undivided. To further reduce the occurrence of false contours and flickers, the brightness ratios of the divided sub-frame portions SF5*a*' and SF5*b* may be the same; the brightness ratios of the divided sub-frame portions SF6*a*' and SF6*b*' may be the same; the brightness ratios of the divided sub-frame portions SF7*a*', SF7*b*', and SF7*c*' may be the same; and the brightness ratios of the divided sub-frame portions SF8*a*', SF8*b*', and SF8*c*' may be the same.

The divided sub-frame portions SF6*a*', SF7*a*', and SF8*a*' are disposed in the first sub-frame group. The divided sub-frame portions SF5*a*', SF7*b*', and SF8*b*' are disposed in the second sub-frame group. The divided sub-frame portions SF5*b*', SF6*b*', SF7*c*', and SF8*c*' are disposed in the third sub-frame group. All of the undivided sub-frames SF1, SF2, SF3, and SF4 are disposed in the second sub-frame group. A black sub-frame "Black" for displaying a black grayscale and having the same brightness ratio as a combination of the undivided sub-frames SF1, SF2, SF3, and SF4 is disposed in the first sub-frame group to improve a contrast ratio.

The brightness ratios of the divided sub-frame portions SF5*a*', SF5*b*', SF6*a*', SF6*b*', SF7*a*', SF7*b*', SF7*c*', SF8*a*', SF8*b*', and SF8*c*' and the arrangement of the divided sub-frame portions, the undivided sub-frames, and the black sub-frame in the first, second, and third sub-frame groups may be selected so that the brightness ratios of the first, second, and third sub-frame groups are the same or substantially the same to further reduce the occurrence of false contours and flickers.

Although FIG. 4 shows the divided sub-frame portions, the undivided sub-frames, and the black sub-frame being arranged in certain arrangements in certain orders in the first, second, and third sub-frame groups, it is understood that other arrangements and/or orders are possible.

The brightness ratios of the sub-frames SF1, SF2, SF3, and SF4 corresponding to the 4 least significant bits of the driving data are relatively low. Thus, even if the sub-frames SF1, SF2, SF3, and SF4 corresponding to the 4 least significant bits of the driving data are not divided into divided sub-frame portions, the occurrence of false contours and flickers is not greatly affected. Therefore, dividing the sub-frames SF1, SF2, SF3, and SF4 corresponding to the 4 least significant bits of the driving data into divided sub-frame portions is typically unnecessary. However, it is understood that some or all of the sub-frames SF1, SF2, SF3, and SF4 may be divided into divided sub-frame portions.

Furthermore, the brightness ratios of the sub-frames SF5 and SF6 corresponding to the 5th and 6th most significant bits of the driving data are lower than the brightness ratios of the sub-frames SF7 and SF8 corresponding to the 7th and 8th most significant bits of the driving data. Thus, according to an aspect of the invention, the sub-frames SF7 and SF8 corresponding to the 7th and 8th most significant bits of the driving data may be divided into three divided sub-frame portions, and the sub-frames SF5 and SF6 corresponding to the 5th and 6th most significant bits of the driving data may be divided into two divided sub-frame portions. In other words, the sub-frames that are divided into three divided sub-frame portions correspond to a first predetermined number of bits of the driving data that are most significant among the bits of the driving data, such as the 7th and 8th most significant bits, and the sub-frames that are divided into two divided sub-frame portions correspond to a second predetermined number of bits of the driving data that are less significant than the first predetermined number of bits of the driving data and more significant than any other ones of the bits of the driving data, such as the 5th and 6th most significant bits. However, it is understood that other divisions are possible.

According to aspects of the invention described above, each of the odd-numbered field and the even-numbered field is divided into three sub-frame groups, some of the sub-frames corresponding to the bits of the driving data are divided into three divided sub-frame portions, some other ones of the sub-frames are divided into two sub-frame portions. However, each of the odd-numbered and even-numbered fields may be divided into a multiple of 3 sub-frame groups, some of the sub-frames corresponding to the bits of the driving data may be divided into a multiple of 3 divided sub-frame portions, and some other ones of the sub-frames may be divided into a multiple of 2 divided sub-frame portions.

The number of sub-frame groups may differ from the number of divided sub-frame portions. Assuming that the number of sub-frame groups is "x", the number of divided sub-frame portions into which some of the sub-frames corresponding to the bits of the driving data are divided is "y", a number of divided sub-frame portions into which some other ones of the sub-frames are divided is "z", and "x", "y", and "z" are each a natural number, then "y" may be smaller than or equal to "x", and "z" may be smaller than "x" and "y". In the example shown in FIG. 4, "x"=3 "y"=3, and "z"=2. However, it is understood that other combinations of "x", y and "z" are possible within the constraints given.

As described above, a method of driving an OLED display device according to an aspect of the invention is an interlaced scanning driving method in which a single frame is divided into an odd-numbered field and an even-numbered field that are sequentially driven. Each of the odd-numbered field and the even-numbered field is divided into three sub-frame groups, some of the sub-frames corresponding to the bits of the driving data are divided into three divided sub-frame portions, and some other ones of the sub-frames are divided into two divided sub-frame portions. By disposing the divided sub-frame portions in different ones of the sub-frame groups, the emission times of neighboring grayscales can be more accurate when displaying sequential images, such as moving images, at a high speed. As a result, the occurrence of false contours and flickers at an interface between the neighboring grayscales can be prevented.

As described above, a method of driving an OLED display device according to an aspect of the invention is an interlaced scanning method in which a single frame is divided into an odd-numbered field and an even-numbered field that are sequentially driven. Each of the odd-numbered field and the even-numbered field is divided into "x" sub-frame groups, some of the sub-frames corresponding to the bits of the driving data are divided into "y" divided sub-frame portions, and some other ones of the sub-frames are divided into "z" divided sub-frame portions. By disposing the divided sub-frame portions in different ones of the sub-frame groups, the emission times of neighboring grayscales can be more accurate when displaying sequential images, such as moving images, at a high speed. As a result, the occurrence of false contours and flickers at an interface between the neighboring grayscales can be prevented.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A method of driving an organic light emitting diode (OLED) display device in an interlaced scanning mode in which a single frame is divided into an odd-numbered field and an even-numbered field that are sequentially driven, the method comprising:

dividing each of the odd-numbered field and the even-numbered field into x sub-frame groups;

dividing each of a plurality of sub-frames corresponding to bits of driving data into y divided sub-frame portions, the sub-frame portions not being further divided;

disposing the y divided sub-frame portions in different ones of the x sub-frame groups; and disposing a black sub-frame between two of the y divided sub-frame portions in a same one of the x sub-frame groups, wherein:

each of x and y is a natural number, y being a single natural number;

the y divided sub-frame portions divided from a respective one of the sub-frames are respectively arranged in a same temporal order of display and at a same position in the different ones of the x sub-frame groups;

some of the plurality of sub-frames corresponding to the bits of the driving data are undivided sub-frames;

all of the undivided sub-frames are arranged in a same one of the x sub-frame groups; and the black sub-frame is not formed from the bits of driving data and is disposed in at least one of the x sub-frame groups other than the one of the x sub-frame groups in which all of the undivided sub-frames are disposed.

2. The method of claim 1, wherein each of x and y is a multiple of 2 or a multiple of 3, and y is smaller than x.

3. The method of claim 1, wherein x is equal to y.

4. The method of claim 1, wherein the y divided sub-frame portions divided from a respective one of the sub-frames have a same brightness ratio.

5. A method of driving an organic light emitting diode (OLED) display device in an interlaced scanning mode in which a single frame is divided into an odd- numbered field and an even-numbered field that are sequentially driven, the method comprising:

dividing each of the odd-numbered field and the even-numbered field into x sub-frame groups;

dividing at least two and less than all of a plurality of sub-frames corresponding to bits of driving data into y divided sub-frame portions, the sub-frame portions not being further divided;

disposing the y divided sub-frame portions in different ones of the x sub-frame groups; and disposing a black sub-frame between two of the y divided sub-frame portions in a same one of the x sub-frame groups, wherein:

each of x and y is a natural number, y being a single natural number;

the y divided sub-frame portions divided from a respective one of the sub-frames are respectively arranged in a same temporal order of display and at a same position in the different ones of the x sub-frame groups;

some of the plurality of sub-frames corresponding to the bits of the driving data are undivided sub-frames all of the undivided sub-frames are arranged in a same one of the x sub-frame groups; and the black sub-frame is not formed from the bits of driving data and is disposed in at least one of the x sub-frame groups other than the one of the x sub-frame groups in which all of the undivided sub-frames are disposed.

6. The method of claim 5, wherein each of x and y is a multiple of 2 or a multiple of 3, and wherein y is smaller than x.

7. The method of claim 5, wherein x is equal to y.

8. The method of claim 7, wherein the black sub-frame is for displaying a black grayscale and has a same brightness ratio as a combination of all of the undivided sub-frames.

9. The method of claim 8, wherein all of the undivided sub-frames and the black sub-frame are disposed at a same position in respective ones of the x sub-frame groups.

10. The method of claim 5, wherein the sub-frames that are divided into the y sub-frame portions correspond to a predetermined number of most significant bits of the driving data.

11. The method of claim 10, wherein the predetermined number of most significant bits is 4.

* * * * *